US008030243B2

(12) United States Patent
Arai et al.

(10) Patent No.: US 8,030,243 B2
(45) Date of Patent: Oct. 4, 2011

(54) HEAT-SENSITIVE TRANSFER IMAGE-RECEIVING SHEET

(75) Inventors: Takuya Arai, Minami-ashigara (JP); Shigeru Shibayama, Minami-ashigara (JP)

(73) Assignee: FUJIFILM Corporation, Tokyo (JP)

( * ) Notice: Subject to any disclaimer, the term of this patent is extended or adjusted under 35 U.S.C. 154(b) by 461 days.

(21) Appl. No.: 12/360,411

(22) Filed: Jan. 27, 2009

(65) Prior Publication Data

US 2009/0191366 A1 Jul. 30, 2009

(30) Foreign Application Priority Data

Jan. 28, 2008 (JP) ..... 2008-016809

(51) Int. Cl.
*B41M 5/035* (2006.01)
*B41M 5/50* (2006.01)

(52) U.S. Cl. ..... 503/227; 428/32.39

(58) Field of Classification Search ..... None
See application file for complete search history.

(56) References Cited

FOREIGN PATENT DOCUMENTS

| | | | |
|---|---|---|---|
| JP | 8-25813 | A | 1/1996 |
| JP | 11-115328 | A | 4/1999 |
| JP | 11-321128 | A | 11/1999 |
| JP | 2006-62114 | A | 3/2006 |
| JP | 2007-264170 | A | 10/2007 |

*Primary Examiner* — Bruce H Hess
(74) *Attorney, Agent, or Firm* — Sughrue Mion, PLLC

(57) ABSTRACT

A heat-sensitive transfer image-receiving sheet, having a support, and at least two heat insulation layers and at least one receiving layer sequentially formed thereon, wherein each of the heat insulation layers comprises at least one kind of hollow particles and at least one kind of water-soluble polymer, and wherein the following relationship is satisfied:

$$1.5 \leqq \{(a1/a2)/(b1/b2)\} \leqq 50$$

wherein a1 is a mass of a hollow particle solid content in the heat insulation layer farthest from the support, a2 is mass of a water-soluble polymer solid content in the heat insulation layer farthest from the support, b1 is a mass of a hollow particle solid content in the heat insulation layer closest to the support, and b2 is a mass of a water-soluble polymer solid content in the heat insulation layer closest to the support.

9 Claims, No Drawings

HEAT-SENSITIVE TRANSFER IMAGE-RECEIVING SHEET

FIELD OF THE INVENTION

The present invention relates to a heat-sensitive transfer image-receiving sheet (hereinafter also referred to simply as image-receiving sheet) for use in a printer which forms an image by transferring a colorant (hereinafter also referred to as a dye) contained in a heat-sensitive transfer sheet (hereinafter also referred to simply as ink sheet) to an image-receiving layer by heat. More specifically, the present invention provides a high-quality image-receiving sheet which is superior in transfer density and image storability and has few image defects.

BACKGROUND OF THE INVENTION

Various heat transfer recording methods have been known so far. Among these methods, dye diffusion transfer recording systems attract attention as a process that can produce a color hard copy having an image quality closest to that of silver halide photography (see, e.g., JP-A-8-25813 ("JP-A" means unexamined published Japanese patent application) and JP-A-11-321128). Moreover, this system has advantages over silver halide photography: it is a dry system, it enables direct visualization from digital data, it makes reproduction simple, and the like.

In the dye diffusion transfer recording systems, a colorant-containing heat-sensitive transfer sheet and a heat-sensitive transfer image-receiving sheet are superposed, and the heat-sensitive transfer sheet is heated using a thermal head with which heat generation can be controlled by electric signals. Thereby a colorant in the heat-sensitive transfer sheet is transferred to the image-receiving sheet to record image information. More specifically, a transferred color image with a continuous change in color shading can be obtained by recording three colors including cyan, magenta and yellow, or four colors including black in addition to the three colors in the manner of one over another.

Owing to a recent progress of computerized digital image processing technique, a quality of the recorded image is improving and a market of the dye diffusion transfer recording system is growing. In accordance with the growth of market, a demand for both speed-up of the print system and high density imaging is increasing.

In the heat-sensitive transfer image-receiving sheet of this system, a receiving layer dyeing the transferred colorant is formed on a support. It is also known that it is possible to improve the dye transfer efficiency by coating a heat insulation layer containing hollow particles on a support and thus utilizing the insulation effect of the voids in the hollow particles, and thus, proposed was a method of raising the density of transferred image further by forming two or more heat insulation layers containing hollow particles (see, e.g., JP-A-2006-62114 and JP-A-2007-264170).

Although the method is effective in increasing the density of the transferred image, the heat-sensitive transfer image-receiving sheet after printing was insufficient in resistance to so-called heat blurring, which means an image blurring when stored at relatively high temperatures. Further, surface irregularity was generated on the sheet during print conveyance by spike scars with the grip rollers that are in contact with the back side of the support. In this way, the method raised a new problem that defects of non-printing occurred in the area to be printed.

On the other hand, printers having a mechanism of holding a heat-sensitive transfer image-receiving sheet with grip rollers consisting of a rubber roller and a metal roller and conveying the sheet reciprocally by their revolution, which are simpler structurally, allow reduction in size and are cheaper, are used most widely (see, e.g., JP-A-11-115328).

In the case of such a printer, the grip rollers consist of a rubber roller for prevention of slipping of paper and a metal roller conveying the heat-sensitive transfer image-receiving sheet accurately by gripping it with fine protrusions (hereinafter referred to as "spikes") having a height of about 40 to 100 μm formed on the surface by etching.

However, in the case where the heat-sensitive transfer image-receiving sheet has a layer mechanically brittle, the spike scars cause serious problems that defects of non-printing on the printed face occur.

SUMMARY OF THE INVENTION

The present invention provides a heat-sensitive transfer image-receiving sheet, comprising a support, and at least two heat insulation layers and at least one receiving layer sequentially formed thereon, wherein each of the heat insulation layers comprises at least one kind of hollow particles and at least one kind of water-soluble polymer, and wherein the relationship between a mass ratio of the hollow particles to the water-soluble polymer in the heat insulation layer farthest from the support and a mass ratio of the hollow particles to the water-soluble polymer in the heat insulation layer closest to the support satisfies the following relationship:

$$1.5 \leqq \{(a1/a2)/(b1/b2)\} \leqq 50$$

wherein a1 is a mass of a hollow particle solid content in the heat insulation layer farthest from the support, a2 is mass of a water-soluble polymer solid content in the heat insulation layer farthest from the support, b1 is a mass of a hollow particle solid content in the heat insulation layer closest to the support, and b2 is a mass of a water-soluble polymer solid content in the heat insulation layer closest to the support.

Other and further features and advantages of the invention will appear more fully from the following description.

DETAILED DESCRIPTION OF THE INVENTION

According to the present invention, there is provided the following means:

(1) A heat-sensitive transfer image-receiving sheet, comprising a support, and at least two heat insulation layers and at least one receiving layer sequentially formed thereon, wherein each of the heat insulation layers comprises at least one kind of hollow particles and at least one kind of water-soluble polymer, and wherein the relationship between a mass ratio of the hollow particles to the water-soluble polymer in the heat insulation layer farthest from the support and a mass ratio of the hollow particles to the water-soluble polymer in the heat insulation layer closest to the support satisfies the following relationship:

$$1.5 \leqq \{(a1/a2)/(b1/b2)\} \leqq 50$$

wherein a1 is a mass of a hollow particle solid content in the heat insulation layer farthest from the support, a2 is mass of a water-soluble polymer solid content in the heat insulation layer farthest from the support, b1 is a mass of a hollow particle solid content in the heat insulation layer closest to the support, and b2 is a mass of a water-soluble polymer solid content in the heat insulation layer closest to the support.

(2) The heat-sensitive transfer image-receiving sheet described in item (1), wherein the ratio of b1/b2 is 0.6 or more and 2.5 or less.

(3) The heat-sensitive transfer image-receiving sheet described in item (1) or (2), wherein the ratio of a1/a2 is 4.0 or more and 20 or less.

(4) The heat-sensitive transfer image-receiving sheet described in any one of items (1) to (3), wherein a solid content coating amount of the heat insulation layer closest to the support is 2.0 to 20 g/m$^2$.

(5) The heat-sensitive transfer image-receiving sheet described in any one of items (1) to (4), wherein a solid content coating amount of the heat insulation layer farthest from the support is 1.0 to 15 g/m$^2$.

(6) The heat-sensitive transfer image-receiving sheet described in any one of items (1) to (5), wherein an average particle diameter of the hollow particles contained in the heat insulation layer closest to the support is 0.1 μm or more and 2.0 μm or less.

(7) The heat-sensitive transfer image-receiving sheet described in any one of items (1) to (6), wherein an average particle diameter of the hollow particles contained in the heat insulation layer farthest from the support is 0.3 μm or more and 5.0 μm or less.

(8) The heat-sensitive transfer image-receiving sheet as described in any one of items (1) to (7), wherein the water-soluble polymer is gelatin or polyvinyl alcohol.

(9) The heat-sensitive transfer image-receiving sheet described in any one of items (1) to (8), wherein the receiving layer contains at least one kind of latex polymer.

The present invention is explained in detail below.

The heat-sensitive transfer image-receiving sheet of the present invention (hereinafter also referred to as "the image-receiving sheet of the present invention") preferably has at least one receptor layer (hereinafter also referred to as "dye receptor layer") on a support, and at least one heat insulation layer between the support and the receptor layer. Further, there may be formed an interlayer having various functions such as white back ground controlling, antistatic, adhesion, and leveling functions between the support and the receptor layer. Further, a releasing layer may be formed at the outermost layer on the side of which a heat-sensitive transfer sheet is superposed.

In the present invention, at least one of the receptor layer and the insulation layer is preferably formed by applying an aqueous coating liquid. Each of these layers is applied using a common method, such as a roll coating, a bar coating, a gravure coating, a gravure reverse coating, a die coating, a slide coating and a curtain coating. Each of the receptor layer, the heat insulation layer and the interlayer may be individually coated. Alternatively, a combination of any of these layers may be applied by simultaneous multilayer coating.

On the side of the support opposite to the receptor layer coating side, a curl adjusting layer, a recording layer or a static adjusting layer may be disposed.

(Receptor Layer)

The heat-sensitive transfer image-receiving sheet of the present invention has at least one receptor layer having a thermoplastic receptive polymer (also referred to as "dyeing polymer") capable of receiving at least a dye.

Examples of preferable receptive polymers include vinyl series resins such as polyvinyl acetate, ethylene vinyl acetate copolymer, vinyl chloride vinyl acetate copolymer, vinyl chloride acrylate copolymer, vinyl chloride methacrylate copolymer, polyacrylic ester, polystyrene, and acrylic polystyrene; acetal resins such as polyvinyl formal, polyvinyl butyral, and polyvinyl acetal; polyester resins such as polyethyleneterephthalate, polybutyleneterephthalate and polycaprolactone; polycarbonate series resins; polyurethane series resins; cellulose series resins; polyolefin series resins such as polypropylene; polyamide series resins; and amino resins such as urea resins, melamine resins and benzoguanamine resins. These resins may be used optionally blending with each other in the range of compatibility.

It is further preferable, among these polymers, to use a polycarbonate, a polyester, a polyurethane, a polyvinyl chloride or a copolymer of vinyl chloride, a styrene-acrylonitrile copolymer, a polycaprolactone or a mixture of two or more of these. It is particularly preferable to use a polyester, a polyvinyl chloride or a copolymer of vinyl chloride, or a mixture of these.

The above-exemplified polymers may be dissolved in a proper organic solvent such as methyl ethyl ketone, ethyl acetate, benzene, toluene, and xylene so that they can be coated on a support. Alternatively, they may be added to an aqueous coating liquid as latex polymer so that they can be coated on a support.

Further, the receptor layer may contain ultraviolet absorbents, release agents, sliding agents, antioxidants, antiseptics, and surfactants.

<Latex Polymer>

It is preferred to contain latex polymer in a receptor layer that is coated in the heat-sensitive transfer image-receiving sheet of the present invention.

The latex polymer for use in the receptor layer is a dispersion in which water-insoluble hydrophobic polymers are dispersed as fine particles in a water-soluble dispersion medium. The dispersed state may be one in which polymer is emulsified in a dispersion medium, one in which polymer underwent emulsion polymerization, one in which polymer underwent micelle dispersion, one in which polymer molecules partially have a hydrophilic structure and thus the molecular chains themselves are dispersed in a molecular state, or the like. The dispersed particles preferably have a mean average particle size (diameter) of about 1 to 50,000 nm, more preferably about 5 to 1,000 nm.

The glass transition temperature (Tg) of the latex polymer that can be used in the present invention is preferably −30° C. to 100° C., more preferably 0° C. to 80° C., further preferably 10° C. to 70° C., and further more preferably 15° C. to 60° C.

In a preferable embodiment of the latex polymer used in the heat-sensitive transfer image-receiving sheet of the present invention, latex polymers such as acrylic-series polymers, polyesters, rubbers (e.g., SBR resins), polyurethanes, polyvinyl chloride copolymers including copolymers such as vinyl chloride/vinyl acetate copolymer, vinyl chloride/acrylate copolymer, and vinyl chloride/methacrylate copolymer; polyvinyl acetate copolymers including copolymers such as ethylene/vinyl acetate copolymer; and polyolefins, are preferably used. These latex polymers may be straight-chain, branched, or cross-linked polymers, the so-called homopolymers obtained by polymerizing single type of monomers, or copolymers obtained by polymerizing two or more types of monomers. In the case of the copolymers, these copolymers may be either random copolymers or block copolymers. The molecular weight of each of these polymers is preferably 5,000 to 1,000,000, and further preferably 10,000 to 500,000 in terms of number-average molecular weight.

The latex polymer according to the present invention is preferably exemplified by any one of polyester latexes; vinyl chloride latex copolymers such as vinyl chloride/acrylic compound latex copolymer, vinyl chloride/vinyl acetate latex copolymer, and vinyl chloride/vinyl acetate/acrylic compound latex copolymer, or arbitrary combinations thereof.

Examples of the vinyl chloride copolymer include those described above. Among these, VINYBLAN 240, VINYBLAN 270, VINYBLAN 276, VINYBLAN 277, VINYBLAN 375, VINYBLAN 380, VINYBLAN 386, VINYBLAN 410, VINYBLAN 430, VINYBLAN 432, VINYBLAN 550, VINYBLAN 601, VINYBLAN 602, VINYBLAN 609, VINYBLAN 619, VINYBLAN 680, VINYBLAN 680S, VINYBLAN 681N, VINYBLAN 683, VINYBLAN 685R, VINYBLAN 690, VINYBLAN 860, VINYBLAN 863, VINYBLAN 685, VINYBLAN 867, VINYBLAN 900, VINYBLAN 938 and VINYBLAN 950 (trade names, manufactured by Nissin Chemical Industry Co., Ltd.); and SE1320, S-830 (trade names, manufactured by Sumica Chemtex) are preferable.

(Polyester Series Latex Polymer)

The polyester series latex is preferably exemplified by Vylonal MD1200, Vylonal MD1220, Vylonal MD1245, Vylonal MD1250, Vylonal MD1500, Vylonal MD1930, Vylonal MD1985 (trade names, manufactured by Toyobo Co., Ltd.).

Among these, vinyl chloride-series latex copolymers such as a vinyl chloride/acrylic compound latex copolymer, a vinyl chloride/vinyl acetate latex copolymer, a vinyl chloride/vinyl acetate/acrylic compound latex copolymer, are more preferable.

The polymer concentration in the latex polymer for use in the present invention is preferably 10 to 70 mass %, more preferably 20 to 60 mass % with respect to the latex solution.

A preferable addition amount of the latex polymer is in the range of 50% by mass to 98% by mass, more preferably 70% by mass to 95% by mass, in terms of solid content of the latex polymer to the total polymer in the receptor layer.

<Water-soluble Polymer>

In the heat-sensitive transfer image-receiving sheet of the present invention, it is one of preferred embodiments of the present invention that the receptor layer contains a water-soluble polymer.

Herein, "water-soluble polymer" means a polymer which dissolves, in 100 g water at 20° C., in an amount of preferably 0.05 g or more, more preferably 0.1 g or more, further preferably 0.5 g or more, and particularly preferably 1 g or more. As the water-soluble polymers, natural polymers, semi-synthetic polymers and synthetic polymers are preferably used.

Examples of the water-soluble polymers for use in the heat-sensitive transfer image-receiving sheet according to the present invention include carrageenans, pectin, dextrin, gelatin, casein, carboxymethylcellulose, hydroxyethylcellulose, hydroxypropylcellulose, polyvinylpyrrolidone, polyvinylpyrrolidone copolymers, polyvinyl alcohol, polyethylene glycol, polypropylene glycol, water-soluble polyesters, and the like. Among them, gelatin and polyvinyl alcohol are preferable.

Gelatin having a molecular weight of 10,000 to 1,000,000 may be used in the present invention. Gelatin that can be used in the present invention may contain an anion such as $Cl^-$ and $SO_4^{2-}$, or alternatively a cation such as $Fe^{2+}$, $Ca^{2+}$, $Mg^{2+}$, $Sn^{2+}$, and $Zn^{2+}$. Gelatin is preferably added as an aqueous solution.

The gelatin above may contain a known crosslinking agent such as aldehyde-type crosslinking agent, N-methylol-type crosslinking agent, vinylsulfone-type crosslinking agent, or chlorotriazine-type crosslinking agent. Among the crosslinking agents above, vinylsulfone-type and chlorotriazine-type crosslinking agents are preferable, and typical examples thereof include bisvinylsulfonylmethylether, N,N'-ethylene-bis(vinylsulfonylacetamido)ethane, and 4,6-dichloro-2-hydroxy-1,3,5-triazine or the sodium salt thereof.

As the polyvinyl alcohol, there can be used various kinds of polyvinyl alcohols such as complete saponification products thereof, partial saponification products thereof, and modified polyvinyl alcohols. With respect to these polyvinyl alcohols, those described in Koichi Nagano, et al., "Poval", Kobunshi Kankokai, Inc. are useful.

The viscosity of polyvinyl alcohol can be adjusted or stabilized by adding a trace amount of a solvent or an inorganic salt to an aqueous solution of polyvinyl alcohol, and use may be made of compounds described in the aforementioned reference "Poval", Koichi Nagano et al., published by Kobunshi Kankokai, pp. 144-154. For example, a coated-surface quality can be improved by the addition of boric acid, and the addition of boric acid is preferable. The amount of boric acid to be added is preferably 0.01 to 40 mass %, with respect to polyvinyl alcohol.

Specific examples of the polyvinyl alcohols include complete saponification polyvinyl alcohol such as PVA-105, PVA-110, PVA-117 and PVA-117H (trade names, manufactured by KURARAY CO., LTD.); partial saponification polyvinyl alcohol such as PVA-203, PVA-205, PVA-210 and PVA-220 (trade names, manufactured by KURARAY CO., LTD.); and modified polyvinyl alcohols such as C-118, HL-12E, KL-118 and MP-203 (trade names, manufactured by KURARAY CO., LTD.).

<Coating>

In the heat-sensitive transfer image-receiving sheet of the present invention, at least one of the receptor layers is preferably coated with an aqueous coating liquid. When a plurality of the receptor layers are prepared, it is preferred that all of these layers are prepared by coating an aqueous coating liquid and drying the resultant. The "aqueous" here means the case where 60% by mass or more of the solvent (dispersion medium) of the coating liquid is water. As a component other than water in the coating liquid, a water miscible organic solvent may be used, such as methyl alcohol, ethyl alcohol, isopropyl alcohol, methyl cellosolve, ethyl cellosolve, dimethylformamide, ethyl acetate, diacetone alcohol, furfuryl alcohol, benzyl alcohol, diethylene glycol monoethyl ether, and oxyethyl phenyl ether.

<Release Agent>

To the heat-sensitive transfer image-receiving sheet of the present invention, a release agent may be added to secure a releasing property between the heat-sensitive transfer sheet and the heat-sensitive transfer image-receiving sheet at the time of image printing.

As the release agent, there can be used, for example, solid waxes such as polyethylene wax, paraffin wax, fatty acid ester wax, and amide wax; and silicone oil, phosphoric ester series compounds, fluorine series surfactants, silicone series surfactants, and other release agents known in this technical field. Of these release agents, preferred are fatty acid ester waxes, fluorine series surfactants, and silicone series compounds such as silicone series surfactants, silicone oil and/or cured products thereof.

<Surfactant>

Further, in the heat-sensitive transfer image-receiving sheet of the present invention, a surfactant may be contained in any of such layers as described above. Of these layers, it is preferable to contain the surfactant in the receptor layer and the intermediate layer.

An addition amount of the surfactant is preferably from 0.01% by mass to 5% by mass, more preferably from 0.01% by mass to 1% by mass, and especially preferably from 0.02% by mass to 0.2% by mass, based on the total solid content.

With respect to the surfactant, various kinds of surfactants such as anionic, nonionic and cationic surfactants are known.

As the surfactant that can be used in the present invention, any known surfactants may be used. For example, it is possible to use surfactants as reviewed in "Kinosei kaimenkasseizai (Functional Surfactants)", editorial supervision of Mitsuo Tsunoda, edition in August in 2000, Chapter 6. Of these surfactants, fluorine-containing anionic surfactants are preferred.

<Matting Agent>

To the heat-sensitive transfer image-receiving sheet of the present invention, a matting agent may be added in order to prevent blocking, or to give a release property or a sliding property. The matting agent may be added on the same side as the coating side of the receptor layer, or on the side opposite to the coating side of the receptor layer, or on both sides.

Examples of the matting agent generally include fine particles of water-insoluble organic compounds and fine particles of water-insoluble inorganic compounds. In the present invention, the organic compound-containing fine particles are preferably used from the view point of dispersion properties. In so far as the organic compound is incorporated in the particles, there may be organic compound particles consisting of the organic compound alone, or alternatively organic/inorganic composite particles containing not only the organic compound but also an inorganic compound. As the matting agent, there can be used organic matting agents described in, for example, U.S. Pat. Nos. 1,939,213, 2,701,245, 2,322,037, 3,262,782, 3,539,344, and 3,767,448.

<Antiseptics>

To the heat-sensitive transfer image-receiving sheet of the present invention, antiseptics may be added. The antiseptics that may be used in the image-receiving sheet of the invention are not particularly limited. For example, use can be made of materials described in Bofubokabi (Preservation and Antifungi) HAND BOOK, Gihodo Shuppan (1986), Bokin Bokabi no Kagaku (Chemistry of Anti-bacteria and Antifungi) authored by Hiroshi Horiguchi, Sankyo Shuppan (1986), Bokin Bokabizai Jiten (Encyclopedia of Antibacterial and Antifungal Agent) edited by The Society for Antibacterial and Antifungal Agent, Japan (1986). Examples thereof include imidazole derivatives, sodium dehydroacetate, 4-isothiazoline-3-on derivatives, benzoisothiazoline-3-on, benzotriazole derivatives, amidineguanidine derivatives, quaternary ammonium salts, pyrrolidine, quinoline, guanidine derivatives, diazine, triazole derivatives, oxazole, oxazine derivatives, and 2-mercaptopyridine-N-oxide or its salt. Of these antiseptics, 4-isothiazoline-3-on derivatives and benzoisothiazoline-3-on are preferred.

The coating amount of all the receptor layers is preferably 0.5 to 10 g/m$^2$ (solid basis, hereinafter, the amount to be applied in the present specification means a numerical value on solid basis, unless otherwise specified). The film thickness of all the receptor layers is preferably in the range of 1 μm to 20 μm.

(Heat Insulation Layer)

The heat insulation layer coated on the heat-sensitive transfer image-receiving sheet of the present invention has at least two heat insulation layers, and may have two or more layers. At least two heat insulation layers or more are provided between the receptor layer and the support.

In the heat-sensitive transfer image-receiving sheet of the present invention, the heat insulation layer preferably contains hollow polymer particles.

The hollow polymer particles (hereinafter also referred to as "hollow particles") in the present invention are polymer particles having voids inside of the particles. The hollow polymer particles are preferably aqueous dispersion. Examples of the hollow polymer particles include (1) non-foaming type hollow polymer particles obtained in the following manner: a dispersion medium such as water is contained inside of a capsule wall formed of a polystyrene, acrylic resin, or styrene/acrylic resin, and, after a coating liquid is applied and dried, the water in the particles is vaporized out of the particles, with the result that the inside of each particle forms a hollow; (2) foaming type microballoons obtained in the following manner: a low-boiling-point liquid such as butane and pentane, is encapsulated in a resin constituted of any one of polyvinylidene chloride, polyacrylonitrile, polyacrylic acid, and polyacrylate, or their mixture or polymer, and after the resin coating material is applied, it is heated to expand the low-boiling-point liquid inside of the particles, whereby the inside of each particle is made to be hollow; and (3) microballoons obtained by foaming the above (2) under heating in advance, to make hollow polymer particles.

Of these, non-foaming hollow polymer particles of the foregoing (1) are preferred. If necessary, use can be made of a mixture of two or more kinds of polymer particles. Specific examples of the above (1) include Rohpake 1055, manufactured by Rohm and Haas Co.; Boncoat PP-1000, manufactured by Dainippon Ink and Chemicals, Incorporated; SX866 (B), manufactured by JSR Corporation; and Nippol MH5055, manufactured by Nippon Zeon (all of these product names are trade names).

The average particle diameter of the hollow particles in the heat insulation layer farthest from the support according to the present invention is preferably 0.3 μm or more and 5.0 μm or less, more preferably 0.8 μm or more 2.0 μm or less. Alternatively, the average particle diameter of the hollow particles in the heat insulation layer closest to the support is preferably 0.1 μm or more and 2.0 μm or less, more preferably 0.3 μm or more and 0.8 μm or less.

The hollow ratio (percentage of void) of the hollow polymer particles is preferably in the range of about 20% to about 80%, and more preferably about 30% to about 70%.

In the present invention, the particle size of the hollow polymer particle is calculated after measurement of the circle-equivalent diameter of the periphery of a particle under a transmission electron microscope. The average particle diameter is determined by measuring the circle-equivalent diameter of the periphery of at least 300 hollow polymer particles observed under the transmission electron microscope and obtaining the average thereof.

The hollow ratio of the hollow polymer particles is calculated by the ratio of the volume of voids to the volume of a particle.

The glass transition temperature (Tg) of the hollow polymer particles is preferably 70° C. or higher and 200° C. or lower, more preferably 90° C. or higher and 180° C. or lower as a resin property. As the hollow polymer particle, a hollow particle latex polymer is specifically preferable.

It is preferred that the heat insulation layer contains a water-soluble polymer as a binder in addition to a hollow polymer particle. A preferable water-soluble polymer is exemplified by water-soluble polymers described in the section of Receptor layer. Among these water-soluble polymers, gelatin and polyvinyl alcohol are more preferable. These resins may be used either singly or as a mixture thereof.

In the present invention, at least two heat insulation layers comprise at least one kind of hollow particles and one kind of water-soluble polymer, and the relationship between the mass ratio of hollow particles to water-soluble polymer in the heat insulation layer farthest from the support and the mass ratio of hollow particles to water-soluble polymer in the heat insulation layer closest to the support preferably satisfies the following relationship:

$$1.5 \leqq (\text{a mass of a hollow particle solid content/a mass of a water-soluble polymer solid content in the heat insulation layer farthest from the support})/(\text{a mass of a hollow particle solid content/a mass of a water-soluble polymer solid content in the heat insulation layer closest to the support}) \leqq 50$$

The ratio of the mass of the hollow particle solid content/the mass of the water-soluble polymer solid content in the heat insulation layer farthest from the support according to the present invention is preferably 4.0 or more and 20 or less, more preferably 5.0 or more and 15 or less. An excessively high water-soluble polymer ratio in the heat insulation layer farthest from the support does not provide sufficient heat insulation, while an excessively low water-soluble polymer ratio leads to deterioration in binding force in film, causing troubles during processing such as scattering of particles and film separation.

Alternatively, the ratio of the mass of the hollow particle solid content/the mass of the water-soluble polymer solid content in the heat insulation layer closest to the support is preferably 0.6 or more and 2.5 or less, more preferably 1.0 or more and 2.0 or less. An excessively high water-soluble polymer ratio in the heat insulation layer closest to the support does not provide sufficient heat insulation, while an excessively low water-soluble polymer ratio leads to deterioration in the heat blurring resistance of the image-receiving sheet after image printing and also in bonding force in film, causing surface irregularity by spike scars with the conveying grip rollers in contact with the back side of the support and causing defects of non-printing on the printed face.

The coating amount of the heat insulation layer farthest from the support according to the present invention is preferably 1.0 to 15 g/m$^2$, more preferably 2.5 to 10 g/m$^2$. Alternatively, the coating amount of the heat insulation layer closest to the support is preferably 2.0 to 20 g/m$^2$, more preferably 3.0 to 15 g/m$^2$.

(Interlayer)

Further, there may be formed an interlayer having various functions such as white back ground controlling, antistatic, adhesion, and leveling functions between the support and the receptor layer. The function of the interlayer is not limited to these, and a previously known interlayer may be provided.

(Support)

As the support for use of the heat-sensitive transfer image-receiving sheet that is used in the present invention, it is possible to use any one of supports known from the past. Among them, a water-proof support is preferably used. The use of the waterproof support makes it possible to prevent the support from absorbing moisture, and thereby a fluctuation in the performance of the receptor layer with lapse of time can be prevented. As the waterproof support, for example, coated paper, laminated paper or synthetic paper may be used. Among them, laminated paper is preferable.

(Curl Adjusting Layer)

In the heat-sensitive transfer image-receiving sheet that is used in the present invention, if necessary, a curl adjusting layer is preferably formed. For the curl adjusting layer, for example, a polyethylene laminate and a polypropylene laminate may be used. Specifically, the curl adjusting layer may be formed in the same manner as described in, for example, JP-A-61-110135 and JP-A-6-202295.

<Writing Layer and Charge Controlling Layer>

In the heat-sensitive transfer image-receiving sheet that is used in the present invention, if necessary, a writing layer or a charge controlling layer may be disposed. For the writing layer and the charge controlling layer, an inorganic oxide colloid, an ionic polymer, an antistatic agent or the like may be used. As the antistatic agent, any antistatic agents including cationic antistatic agents such as a quaternary ammonium salt and polyamine derivative, anionic antistatic agents such as alkyl phosphate, and nonionic antistatic agents such as fatty acid ester may be used. Specifically, the writing layer and the charge controlling layer may be formed in a manner similar to those described in the specification of Japanese Patent No. 3585585.

(Image-forming Method)

In the image-forming method of the present invention, imaging is achieved by superposing a heat-sensitive transfer sheet on a heat-sensitive transfer image-receiving sheet so that a heat transfer layer of the heat-sensitive transfer sheet is in contact with a receptor layer of the heat-sensitive transfer image-receiving sheet and giving thermal energy in accordance with image signals given from a thermal head.

Specifically, image-forming can be achieved by the similar manner to that as described in, for example, JP-A-2005-88545. In the present invention, a printing time is preferably less than 15 seconds, and more preferably in the range of 3 to 12 seconds, and further preferably 3 to 7 seconds, from the viewpoint of shortening a time taken until a consumer gets a print.

In order to accomplish the above-described printing time, a line speed at the time of printing is preferably 0.73 msec/line or less, and more preferably 0.65 msec/line or less. Further, from the viewpoint of improvement in transfer efficiency as one of speeding-up conditions, the maximum ultimate temperature of the thermal head at the time of printing is preferably in the range of 180° C. or higher to 450° C. or lower, more preferably 200° C. or higher to 450° C. or lower, and furthermore preferably 350° C. or higher to 450° C. or lower.

The method of the present invention may be utilized for printers, copying machines and the like, which employs a heat-sensitive transfer recording system. As a means for providing heat energy at the time of thermal transfer, any of the conventionally known providing means may be used. For example, application of a heat energy of about 5 to 100 mJ/mm$^2$ by controlling recording time in a recording device such as a thermal printer (e.g., trade name: Video Printer VY-100, manufactured by Hitachi, Ltd.), sufficiently attains the expected result. Also, the heat-sensitive transfer image-receiving sheet for use in the present invention may be used in various applications enabling thermal transfer recording, such as heat-sensitive transfer image-receiving sheets in a form of thin sheets (cut sheets) or rolls; cards; and transmittable type manuscript-making sheets, by optionally selecting the type of support.

The image-printing mechanism of the printer in which the heat-sensitive transfer image-receiving sheet according to the present invention is favorably used is shown, for example, in the schematic view exemplified in FIG. 3 of JP-A-11-115328. The printer is a type of printer conveying the heat-sensitive transfer image-receiving sheet with grip rollers. The grip rollers consists of a rubber roller for preventing slipping of paper and a metal roller accurately conveying the heat-sensitive transfer image-receiving sheet by holding it with spikes having a height of about 40 to 100 μm formed on the surface by etching.

The present invention provides a heat-sensitive transfer image-receiving sheet which is superior in transfer density and image storability and has few image defects. Specifically, the present invention provides a heat-sensitive transfer image-receiving sheet which has high transferred image density, less heat blurring during image storage, few image defects caused by roller spiking scars during print conveyance.

The present invention will be described in more detail based on the following examples, but the invention is not intended to be limited thereto. In the following examples, the terms "part(s)" and "%" are values by mass, unless otherwise specified.

EXAMPLES (Preparation of a Heat-sensitive Transfer Sheet)

A polyester film 6.0 μm in thickness (trade name: Diafoil K200E-6F, manufactured by MITSUBISHI POLYESTER FILM CORPORATION), that was subjected to an easy adhesion-treatment on one surface of the film, was used as a support. The following back side layer-coating liquid was applied onto the support on the other surface that was not subjected to the easy adhesion-treatment, so that the coating amount based on the solid content after drying would be 1 g/m$^2$. After drying, the coated film was cured by heat at 60° C.

A heat-sensitive transfer sheet was prepared by coating the following coating liquids on the easy adhesion layer coating side of the thus-prepared polyester film so that a yellow dye layer, a magenta dye layer, a cyan dye layer, and a protective layer laminate could be disposed sequentially in this area order. The coating amount of each dye layer based on the solid content was 0.8 g/m$^2$.

In the case of forming the protective layer laminate, after applying and drying of a coating liquid for a releasing layer on a substrate, a coating liquid for a protective layer was applied thereon and dried. After that, a coating liquid for an adhesive layer was applied and then dried.

| Back side layer-coating liquid | |
|---|---|
| Acrylic-series polyoi resin (trade name: ACRYDIC A-801, manufactured by Dainippon Ink and Chemicals, Incorporated) | 27.0 mass parts |
| Zinc stearate (trade name: SZ-2000, manufactured by Sakai Chemical Industry Co., Ltd.) | 0.33 mass part |
| Phosphate (trade name: PLYSURF A217, manufactured byDai-ichi Kogyo Seiyaku Co., Ltd.) | 1.17 mass parts |
| Isocyanate (50% solution) (trade name: BURNOCK D-800, manufactured by Dainippon Ink and Chemicals, Incorporated) | 7.2 mass parts |
| Methyl ethyl ketone/Toluene (2/1, at mass ratio) | 64 mass parts |

| Yellow dye layer-coating liquid | |
|---|---|
| Dye compound (Y-1) | 4.5 mass parts |
| Dye compound (Y-2) | 3.3 mass parts |
| Polyvinylacetal resin (trade name: ESLEC KS-1, manufactured by Sekisui Chemical Co., Ltd.) | 6.2 mass parts |
| Polyvinylbutyral resin (trade name: DENKA BUTYRAL#6000-C, manufactured by DENKI KAGAKU KOGYOU K. K.) | 2.2 mass parts |
| Release agent (trade name: X-22-3000T, manufactured by Shin-Etsu Chemical Co., Ltd.) | 0.05 mass part |
| Release agent (trade name: TSF4701, manufactured by MOMENTIVE Performance Materials Japan LLC.) | 0.03 mass part |
| Matting agent (trade name: Flo-thene UF, manufactured by Sumitomo Seika Chemicals Co., Ltd.) | 0.15 mass part |
| Methyl ethyl ketone/Toluene (2/1, at mass ratio) | 84 mass parts |

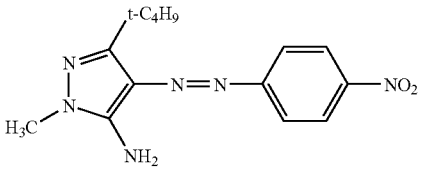

Y-1

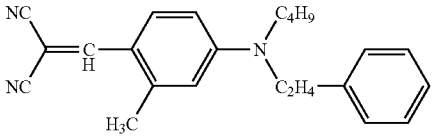

Y-2

| Magenta dye layer-coating liquid | |
|---|---|
| Dye compound (M-1) | 0.3 mass part |
| Dye compound (M-2) | 1.1 mass parts |
| Dye compound (M-3) | 6.0 mass parts |
| Polyvinylacetal resin (trade name: ESLEC KS-1, manufactured by Sekisui Chemical Co., Ltd.) | 8.0 mass parts |
| Polyvinylbutyral resin (trade name: DENKA BUTYRAL#6000-C, manufactured by DENKI KAGAKU KOGYOU K. K.) | 0.2 mass part |
| Release agent (trade name: X-22-3000T, manufactured by Shin-Etsu Chemical Co., Ltd.) | 0.05 mass part |
| Release agent (trade name: TSF4701, manufactured by MOMENTIVE Performance Materials Japan LLC.) | 0.03 mass part |
| Matting agent (trade name: Flo-thene UF, manufactured by Sumitomo Seika Chemicals Co., Ltd.) | 0.15 mass part |
| Methyl ethyl ketone/Toluene (2/1, at mass ratio) | 84 mass parts |

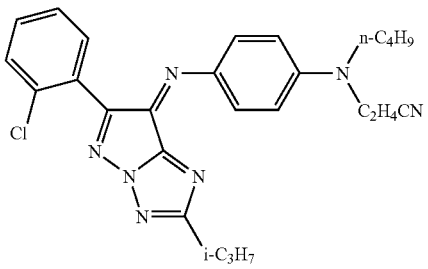

M-1

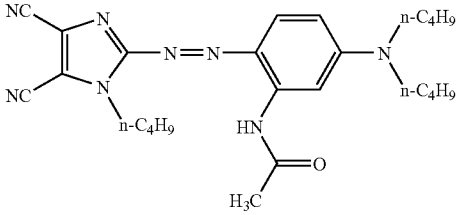

M-2

-continued

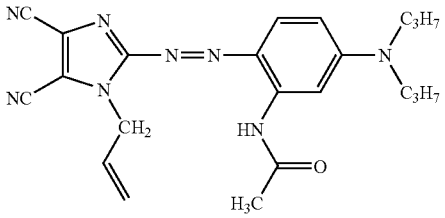

M-3

Cyan dye layer-coating liquid

| | |
|---|---|
| Dye compound (C-1) | 1.8 mass parts |
| Dye compound (C-2) | 6.0 mass parts |
| Polyvinylacetal resin (trade name: ESLEC KS-1, manufactured by Sekisui Chemical Co., Ltd.) | 7.4 mass parts |
| Polyvinylbutyral resin (trade name: DENKA BUTYRAL#6000-C, manufactured by DENKI KAGAKU KOGYOU K. K.) | 0.8 mass part |
| Release agent (trade name: X-22-3000T, manufactured by Shin-Etsu Chemical Co., Ltd.) | 0.05 mass part |
| Release agent (trade name: TSF4701, manufactured by MOMENTIVE Performance Materials Japan LLC.) | 0.03 mass part |
| Matting agent (trade name: Flo-thene UF, manufactured by Sumitomo Seika Chemicals Co., Ltd.) | 0.15 masspart |
| Methyl ethyl ketone/Toluene (2/1, at mass ratio) | 84 mass parts |

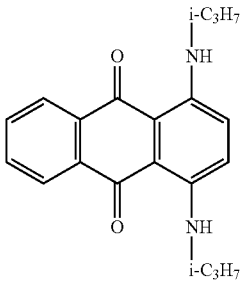

C-1

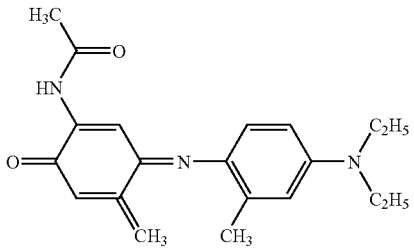

C-2

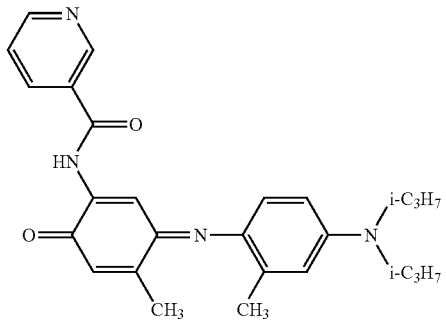

C-3

(Transfer Protective Layer Laminate)

On the same polyester film as used in the preparation of the dye layers as described above, coating liquids of a releasing layer, a protective layer and an adhesive layer each having the following composition was coated, to form a transfer protective layer laminate. Coating amounts of the releasing layer, the protective layer and the adhesive layer after drying were set to 0.4 g/m$^2$, 0.6 g/m$^2$ and 2.0 g/m$^2$, respectively.

| Releasing layer-coating liquid | |
|---|---|
| Modified cellulose resin (trade name: L-30, manufactured byDAICEL CHEMICAL INDUSTRIES, LTD.) | 4.0 mass parts |
| Methyl ethyl ketone | 96.0 mass parts |
| Protective layer-coating liquid | |
| Acrylic resin solution (solid content: 40%) (trade name: DIANAL BR-100, manufactured by MITSUBISHI RAYON CO., LTD.) | 91 mass parts |
| Methanol/Isopropanol (1/1, at mass ratio) | 9 mass parts |
| Adhesive layer-coating liquid | |
| Acrylic resin (trade name: DIANAL BR-77, manufactured by MITSUBISHI RAYON CO., LTD.) | 25 mass parts |
| The following ultraviolet absorbent UV-1 | 1 mass part |
| The following ultraviolet absorbent UV-2 | 1 mass part |
| The following ultraviolet absorbent UV-3 | 2 mass parts |
| The following ultraviolet absorbent UV-4 | 1 mass part |
| PMMA fine particles (polymethyl methacrylate fine particles) | 0.4 mass part |
| Methyl ethyl ketone/Toluene (2/1, at mass ratio) | 70 mass parts |

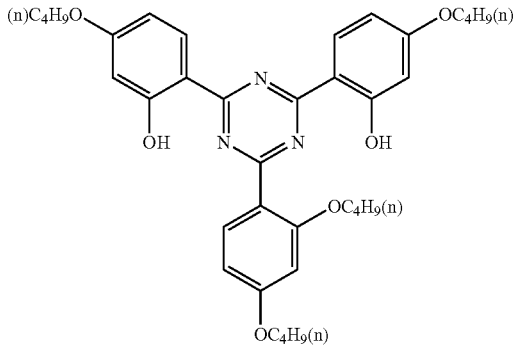

(UV-1)

-continued

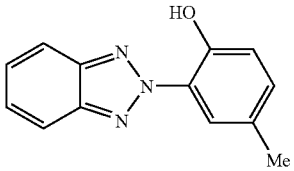

(UV-2)

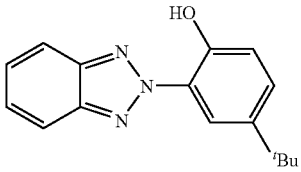

(UV-3)

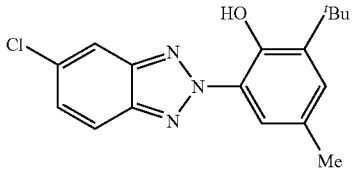

(UV-4)

(Preparation of Heat-sensitive Image-Receiving Sheet 1)

A paper support, on both sides of which polyethylene was laminated, was subjected to corona discharge treatment on the surface thereof, and then a gelatin undercoat layer containing sodium dodecylbenzenesulfonate was disposed on the treated surface. A subbing layer, a lower heat insulation layer, an upper heat insulation layer and a receptor layer each having the following composition were simultaneously multi-layer-coated on the gelatin undercoat layer, in the state that the subbing layer, the lower heat insulation layer, the upper heat insulation layer and the receptor layer were laminated in this order from the side of the support, by a method illustrated in FIG. 9 in U.S. Pat. No. 2,761,791. In this case, the layer closest from the support is the lower heat insulation layer and the layer farthest from the support is the upper heat insulation layer. The coating was performed so that coating amounts of the subbing layer, the lower heat insulation layer, the upper heat insulation layer and the receptor layer after drying would be 6.4 g/m$^2$, 25 g/m$^2$, 2.0 g/m$^2$ and 2.5 g/m$^2$, respectively. The following compositions are presented by mass parts as solid contents.

| Receptor layer-coating liquid 1 | |
|---|---|
| Vinyl chloride-series latex (trade name: Vinybran 900, manufactured by Nissin Chemicals Co., Ltd.) | 18.0 mass parts |
| Vinyl chloride-series latex (trade name: Vinybran 690, manufactured by Nissin Chemicals Co., Ltd.) | 18.0 mass parts |
| Gelatin (10% aqueous solution) | 2.0 mass parts |
| The following ester-series wax EW-1 | 2.0 mass parts |
| The following surfactant F-1 | 0.07 mass part |
| The following surfactant F-2 | 0.36 mass part |

Upper Heat Insulation Layer-coating Liquid 1

The upper heat insulation layer-coating liquid 2 for the heat-sensitive transfer image-receiving sheet 8 described in the Example of JP-A-2006-62114 was prepared and used.

| | |
|---|---|
| Acrylic styrene series hollow particles (Nipol MH5055, manufactured by Nippon Zeon Corporation, average diameter: 0.5 μm, solid content: 30%) | 2 mass parts |
| Alkali-treated gelatin | 4.2 mass parts |
| Water | 104.4 mass parts |

Lower Heat Insulation Layer-coating Liquid 1

The lower heat insulation layer-coating liquid 2 for the heat-sensitive transfer image-receiving sheet 8 described in the Example of JP-A-2006-62114 was prepared and used.

| | |
|---|---|
| Acrylic styrene series hollow particles (Nipol MH5055, manufactured by Nippon Zeon Corporation, average diameter: 0.5 μm, solid content: 30%) | 100 mass parts |
| Alkali-treated gelatin | 7.5 mass parts |
| Water | 128 mass parts |

Subbing layer-coating liquid 1

| | |
|---|---|
| Polyvinyl alcohol (trade name: POVAL PVA 205, manufactured by Kuraray) | 5.0 mass parts |
| Styrene butadiene rubber latex (trade name: SN-307, manufactured by NIPPON A & L INC.) | 61.7 mass parts |

(EW-1)

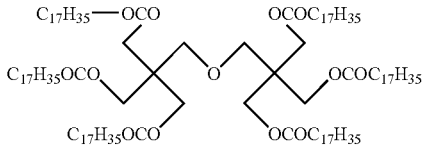

(F-1)

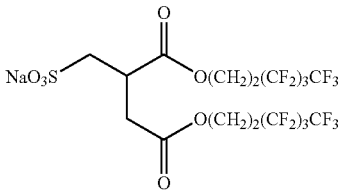

(F-2)

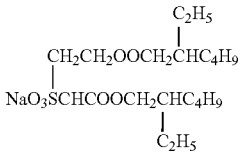

(Preparation of Heat-sensitive Transfer Image-receiving Sheet 2)

Heat-sensitive transfer image-receiving sheet 2 was prepared in a manner similar to the heat-sensitive transfer image-receiving sheet 1, except that the following upper heat insulation layer-coating liquid 2 was used as the upper heat insulation layer-coating liquid, the following lower heat insulation layer-coating liquid 2 was used as the lower heat insulation layer-coating liquid, and the coating amounts of the lower heat insulation layer and the upper heat insulation layer after drying would be 40 g/m$^2$ and 5.0 g/m$^2$, respectively.

Upper Heat Insulation Layer-coating Liquid 2

The heat insulation layer-coating liquid 1 for the sample No. 212 described in the Example of JP-A-2007-264170 was prepared and used.

| | |
|---|---|
| Hollow particle dispersion (main component: styrene-acrylic copolymer, average diameter: 0.3 μm, hollow ratio: 60%, solid content: 30%) | 50 mass parts |
| Gelatin | 4 mass parts |
| Aqueous solution of 2,4-dichloro-6-hydroxy-1,3,5-s-triazine sodium salt (solid content: 7.5%) | 2 mass parts |
| Aqueous solution of sodium dioctyl-sulfosuccinate (solid content: 20%) | 2 mass parts |
| Water | 42 mass parts |

Lower Heat Insulation Layer-coating Liquid 2

The heat insulation layer-coating liquid 16 for the sample No. 212 described in the Example of JP-A-2007-264170 was prepared and used.

| | |
|---|---|
| Hollow particle dispersion (main component: styrene-acrylic copolymer, average diameter: 1.0 μm, hollow ratio: 50%, solid content: 30%) | 50 mass parts |
| Gelatin | 4 mass parts |
| Aqueous solution of 2,4-dichloro-6-hydroxy-1,3,5-s-triazine sodium salt (solid content: 7.5%) | 2 mass parts |
| Aqueous solution of sodium dioctyl-sulfosuccinate (solid content: 20%) | 2 mass parts |
| Water | 42 mass parts |

(Preparation of Heat-sensitive Transfer Image-receiving Sheet 3)

Heat-sensitive transfer image-receiving sheet 3 was prepared in a manner similar to the heat-sensitive transfer image-receiving sheet 1, except that the coating amounts of the lower heat insulation layer and the upper heat insulation layer after drying would be 7.0 g/m$^2$ and 5.0 g/m$^2$, respectively.

(Preparation of Heat-sensitive Transfer Image-receiving Sheet 4)

Heat-sensitive transfer image-receiving sheet 4 was prepared in a manner similar to the heat-sensitive transfer image-receiving sheet 2, except that the coating amount of the lower heat insulation layer after drying would be 7.0 g/m$^2$.

(Preparation of Heat-sensitive Transfer Image-receiving Sheet 5)

Heat-sensitive transfer image-receiving sheet 5 was prepared in a manner similar to the heat-sensitive transfer image-receiving sheet 4, except that the following upper heat insulation layer-coating liquid 3 was used as the upper heat insulation layer-coating liquid and the following lower heat insulation layer-coating liquid 3 was used as the lower heat insulation layer-coating liquid.

| Upper heat insulation layer-coating liquid 3 | |
|---|---|
| Acrylic styrene series hollow particles (Nipol MH5055, manufactured by Nippon Zeon Corporation, average diameter: 0.5 μm, solid content: 30%) | 37 mass parts |
| Gelatin (10% aqueous solution) | 16 mass parts |
| Water | 37 mass parts |
| **Lower heat insulation layer-coating liquid 3** | |
| Acrylic styrene series hollow particles (Nipol MH5055, manufactured by Nippon Zeon Corporation, average diameter: 0.5 μm, solid content: 30%) | 13 mass parts |
| Gelatin (10% aqueous solution) | 26 mass parts |

(Preparation of Heat-sensitive Transfer Image-receiving Sheet 6)

Heat-sensitive transfer image-receiving sheet 6 was prepared in a manner similar to the heat-sensitive transfer image-receiving sheet 5, except that the following upper heat insulation layer-coating liquid 4 was used as the upper heat insulation layer-coating liquid and the following lower heat insulation layer-coating liquid 4 was used as the lower heat insulation layer-coating liquid.

| Upper heat insulation layer-coating liquid 4 | |
|---|---|
| Acrylic styrene series hollow particles (Nipol MH5055, manufactured by Nippon Zeon Corporation, average diameter: 0.5 μm, solid content: 30%) | 27 mass parts |
| Gelatin (10% aqueous solution) | 20 mass parts |
| Water | 43 mass parts |
| **Lower heat insulation layer-coating liquid 4** | |
| Acrylic styrene series hollow particles (Nipol MH5055, manufactured by Nippon Zeon Corporation, average diameter: 0.5 μm, solid content: 30%) | 22 mass parts |
| Gelatin (10% aqueous solution) | 29 mass parts |

(Preparation of Heat-sensitive Transfer Image-receiving Sheet 7)

Heat-sensitive transfer image-receiving sheet 7 was prepared in a manner similar to the heat-sensitive transfer image-receiving sheet 5, except that the following upper heat insulation layer-coating liquid 5 was used as the upper heat insulation layer-coating liquid and the following lower heat insulation layer-coating liquid 5 was used as the lower heat insulation layer-coating liquid.

| Upper heat insulation layer-coating liquid 5 | |
|---|---|
| Acrylic styrene series hollow particles (Nipol MH5055, manufactured by Nippon Zeon Corporation, average diameter: 0.5 μm, solid content: 30%) | 30 mass parts |
| Gelatin (10% aqueous solution) | 10 mass parts |
| Water | 50 mass parts |
| **Lower heat insulation layer-coating liquid 5** | |
| Acrylic styrene series hollow particles (Nipol MH5055, manufactured by Nippon Zeon Corporation, average diameter: 0.5 μm, solid content: 30%) | 13 mass parts |
| Gelatin (10% aqueous solution) | 40 mass parts |

(Preparation of Heat-sensitive Transfer Image-receiving Sheet 8)

Heat-sensitive transfer image-receiving sheet 8 was prepared in a manner similar to the heat-sensitive transfer image-receiving sheet 5, except that the following upper heat insulation layer-coating liquid 6 was used as the upper heat insulation layer-coating liquid and the following lower heat insulation layer-coating liquid 6 was used as the lower heat insulation layer-coating liquid.

| Upper heat insulation layer-coating liquid 6 | |
|---|---|
| Acrylic styrene series hollow particles (Nipol MH5055, manufactured by Nippon Zeon Corporation, average diameter: 0.5 μm, solid content: 30%) | 25 mass parts |
| Gelatin (10% aqueous solution) | 4 mass parts |
| Water | 40 mass parts |
| **Lower heat insulation layer-coating liquid 6** | |
| Acrylic styrene series hollow particles (Nipol MH5055, manufactured by Nippon Zeon Corporation, average diameter: 0.5 μm, solid content: 30%) | 12 mass parts |
| Gelatin (10% aqueous solution) | 49 mass parts |

(Preparation of Heat-sensitive Transfer Image-receiving Sheet 9)

Heat-sensitive transfer image-receiving sheet 9 was prepared in a manner similar to the heat-sensitive transfer image-receiving sheet 8, except that the following upper heat insulation layer-coating liquid 7 was used as the upper heat insulation layer-coating liquid and the following lower heat insulation layer-coating liquid 7 was used as the lower heat insulation layer-coating liquid. In addition, the hollow particles were prepared with reference to the Examples described in JP-A-56-32513.

| Upper heat insulation layer-coating liquid 7 | |
|---|---|
| Hollow particles (main component: styrene-acrylic copolymer, average diameter: 0.3 μm, solid content: 30%) | 37 mass parts |
| Gelatin (10% aqueous solution) | 16 mass parts |
| Water | 37 mass parts |
| **Lower heat insulation layer-coating liquid 7** | |
| Hollow particles (main component: styrene-acrylic copolymer, average diameter: 1.0 μm, solid content: 30%) | 13 mass parts |
| Gelatin (10% aqueous solution) | 26 mass parts |

(Preparation of Heat-sensitive Transfer Image-receiving Sheet 10)

Heat-sensitive transfer image-receiving sheet 10 was prepared in a manner similar to the heat-sensitive transfer image-receiving sheet 9, except that the following upper heat insulation layer-coating liquid 8 was used as the upper heat insulation layer-coating liquid and the following lower heat insulation layer-coating liquid 8 was used as the lower heat insulation layer-coating liquid.

| Upper heat insulation layer-coating liquid 8 | |
|---|---|
| Hollow particles (main component: styrene-acrylic copolymer, average diameter: 0.3 μm, solid content: 30%) | 27 mass parts |
| Gelatin (10% aqueous solution) | 20 mass parts |
| Water | 43 mass parts |
| **Lower heat insulation layer-coating liquid 8** | |
| Hollow particles (main component: styrene-acrylic copolymer, average diameter: 1.0 μm, solid content: 30%) | 22 mass parts |
| Gelatin (10% aqueous solution) | 29 mass parts |

(Preparation of Heat-sensitive Transfer Image-receiving Sheet 11)

Heat-sensitive transfer image-receiving sheet 11 was prepared in a manner similar to the heat-sensitive transfer image-receiving sheet 9, except that the following upper heat insulation layer-coating liquid 9 was used as the upper heat insulation layer-coating liquid and the following lower heat insulation layer-coating liquid 9 was used as the lower heat insulation layer-coating liquid.

| Upper heat insulation layer-coating liquid 9 | |
|---|---|
| Hollow particles (main component: styrene-acrylic copolymer, average diameter: 1.0 μm, solid content: 30%) | 37 mass parts |

-continued

| | |
|---|---|
| Gelatin (10% aqueous solution) | 16 mass parts |
| Water | 37 mass parts |
| **Lower heat insulation layer-coating liquid 9** | |
| Hollow particles (main component: styrene-acrylic copolymer, average diameter: 0.6 μm, solid content: 30%) | 13 mass parts |
| Gelatin (10% aqueous solution) | 26 mass parts |

(Preparation of Heat-sensitive Transfer Image-receiving Sheet 12)

Heat-sensitive transfer image-receiving sheet 12 was prepared in a manner similar to the heat-sensitive transfer image-receiving sheet 9, except that the following upper heat insulation layer-coating liquid 10 was used as the upper heat insulation layer-coating liquid and the following lower heat insulation layer-coating liquid 10 was used as the lower heat insulation layer-coating liquid.

| Upper heat insulation layer-coating liquid 10 | |
|---|---|
| Hollow particles (main component: styrene-acrylic copolymer, average diameter: 1.0 μm, solid content: 30%) | 27 mass parts |
| Gelatin (10% aqueous solution) | 20 mass parts |
| Water | 43 mass parts |
| **Lower heat insulation layer-coating liquid 10** | |
| Hollow particles (main component: styrene-acrylic copolymer, average diameter: 0.6 μm, solid content: 30%) | 22 mass parts |
| Gelatin (10% aqueous solution) | 29 mass parts |

(Preparation of Heat-sensitive Transfer Image-receiving Sheet 13)

Heat-sensitive transfer image-receiving sheet 13 was prepared in a manner similar to the heat-sensitive transfer image-receiving sheet 9, except that the following upper heat insulation layer-coating liquid 11 was used as the upper heat insulation layer-coating liquid and the following lower heat insulation layer-coating liquid 11 was used as the lower heat insulation layer-coating liquid.

| Upper heat insulation layer-coating liquid 11 | |
|---|---|
| Hollow particles (main component: styrene-acrylic copolymer, average diameter: 1.0 μm, solid content: 30%) | 37 mass parts |
| Gelatin (10% aqueous solution) | 16 mass parts |
| Water | 37 mass parts |
| **Lower heat insulation layer-coating liquid 11** | |
| Hollow particles (main component: styrene-acrylic copolymer, average diameter: 1.0 μm, solid content: 30%) | 13 mass parts |
| Gelatin (10% aqueous solution) | 26 mass parts |

(Image-forming)

The printer used for image-forming was Fuji Film thermal photoprinter ASK-2000L (trade name) manufactured by Fuji Photo Film Co., Ltd. The printer was modified to accept both the heat-sensitive transfer sheet and the heat-sensitive transfer image-receiving sheet above, and a black painted image at the highest density, a gray painted image at a density of 0.4, and a thin-line image were printed.

(Evaluation of Image)

(Transferred Image Density)

The V density of the black painted image obtained at the highest density in the image-forming above was determined by using Xrite 310 (trade name, manufactured by Xrite). The transferred image density was evaluated as a relative value with respect to 100 of the density on the heat-sensitive transfer image-receiving sheet 4.

2: Some thin line blurring observed, when compared with the sample before heat treatment, at a level practically causing problems 1: Significant thin line blurring observed, when compared with the sample before heat treatment, at a level practically causing problems The results thus obtained are represented in the following Table 1.

TABLE 1

| Heat-Sensitive Transfer Image-receiving Sheet No. | Upper Heat Insulation Layer: Average Diameter of Hollow particles [μm] | Upper Heat Insulation Layer: [A] Mass Ratio of Hollow Particles to Water-soluble Polymer | Upper Heat Insulation Layer: Coating Amount [g/cm$^2$] | Lower Heat Insulation Layer: Average Diameter of Hollow particles [μm] | Lower Heat Insulation Layer: [B] Mass Ratio of Hollow Particles to Water-soluble Polymer | Lower Heat Insulation Layer: Coating Amount [g/cm$^2$] | [A]/[B] | Results of each Evaluation: Transferred Image Density | Image Defect | Image Storage Stability | Remarks |
|---|---|---|---|---|---|---|---|---|---|---|---|
| 1 | 0.5 | 0.14 | 2.0 | 0.5 | 4.0 | 25 | 0.04 | 102 | 2 | 1 | Comparative Example |
| 2 | 0.3 | 3.8 | 5.0 | 1.0 | 3.8 | 40 | 1.0 | 104 | 2 | 1 | Comparative Example |
| 3 | 0.5 | 0.14 | 5.0 | 0.5 | 4.0 | 7.0 | 0.04 | 98 | 1 | 2 | Comparative Example |
| 4 | 0.3 | 3.8 | 5.0 | 1.0 | 3.8 | 7.0 | 1.0 | 100 | 1 | 2 | Comparative Example |
| 5 | 0.5 | 7.0 | 5.0 | 0.5 | 1.5 | 7.0 | 3.3 | 110 | 5 | 5 | This Invention |
| 6 | 0.5 | 4.0 | 5.0 | 0.5 | 2.3 | 7.0 | 1.7 | 108 | 4 | 4 | This Invention |
| 7 | 0.5 | 9.0 | 5.0 | 0.5 | 1.0 | 7.0 | 9.0 | 114 | 3 | 4 | This Invention |
| 8 | 0.5 | 19.0 | 5.0 | 0.5 | 0.7 | 7.0 | 27.1 | 116 | 3 | 3 | This Invention |
| 9 | 0.3 | 7.0 | 5.0 | 1.0 | 1.5 | 7.0 | 3.3 | 108 | 4 | 4 | This Invention |
| 10 | 0.3 | 4.0 | 5.0 | 1.0 | 2.3 | 7.0 | 1.7 | 109 | 3 | 4 | This Invention |
| 11 | 1.0 | 7.0 | 5.0 | 0.6 | 1.5 | 7.0 | 3.3 | 115 | 5 | 5 | This Invention |
| 12 | 1.0 | 4.0 | 5.0 | 0.6 | 2.3 | 7.0 | 1.7 | 112 | 5 | 4 | This Invention |
| 13 | 1.0 | 7.0 | 5.0 | 1.0 | 1.5 | 7.0 | 3.3 | 117 | 4 | 4 | This Invention |

(Image Defect)

In the gray painted image at a density of 0.4 obtained by the image-forming above, the image defects generated on the printed face by spike scars of the conveying rollers were evaluated.

5: No image defect observed in image

4: Almost no image defect observed in image

3: Some scattered image defects observed in image, but in a practically allowable range 2: Several image defects observed in image, at a level practically causing problems 1: Many severe image defects observed in image, at a level practically causing problems (Image Storage Stability)

The thin-line image sample obtained by the image-forming above was heated at 60° C. for 2 weeks, and the degree of heat blurring of the image was compared with that before heat treatment, for evaluation of the image storage stability.

5: No thin line blurring observed, when compared with the sample before heat treatment 4: Almost no thin line blurring observed, when compared with the sample before heat treatment 3: Weak thin line blurring observed, when compared with the sample before heat treatment, but in a practically allowable range As obvious from the results in Table 1 above, the heat-sensitive transfer image-receiving sheets 5 to 13 according to the present invention gave a high-quality image which has high transferred image density, less heat blurring during image storage, few image defects caused by roller spiking scars during print conveyance.

Having described our invention as related to the present embodiments, it is our intention that the invention not be limited by any of the details of the description, unless otherwise specified, but rather be construed broadly within its spirit and scope as set out in the accompanying claims.

What we claim is:

1. A heat-sensitive transfer image-receiving sheet, comprising a support, and at least two heat insulation layers and at least one receiving layer sequentially formed thereon, wherein each of the heat insulation layers comprises at least one kind of hollow particles and at least one kind of water-soluble polymer, and wherein the relationship between a mass ratio of the hollow particles to the water-soluble polymer in the heat insulation layer farthest from the support and a mass ratio of the hollow particles to the water-soluble polymer in the heat insulation layer closest to the support satisfies the following relationship:

$$1.5 \leqq \{(a1/a2)/(b1/b2)\} \leqq 50$$

wherein a1 is a mass of a hollow particle solid content in the heat insulation layer farthest from the support, a2 is mass of a water-soluble polymer solid content in the heat insulation layer farthest from the support, b1 is a mass of a hollow particle solid content in the heat insulation layer closest to the support, and b2 is a mass of a water-soluble polymer solid content in the heat insulation layer closest to the support.

2. The heat-sensitive transfer image-receiving sheet according to claim 1, wherein the ratio of b1/b2 is 0.6 or more and 2.5 or less.

3. The heat-sensitive transfer image-receiving sheet according to claim 1, wherein the ratio of a1/a2 is 4.0 or more and 20 or less.

4. The heat-sensitive transfer image-receiving sheet according to claim 1, wherein a solid content coating amount of the heat insulation layer closest to the support is 2.0 to 20 $g/m^2$.

5. The heat-sensitive transfer image-receiving sheet according to claim 1, wherein a solid content coating amount of the heat insulation layer farthest from the support is 1.0 to 15 $g/m^2$.

6. The heat-sensitive transfer image-receiving sheet according to claim 1, wherein an average particle diameter of the hollow particles contained in the heat insulation layer closest to the support is 0.1 μm or more and 2.0 μm or less.

7. The heat-sensitive transfer image-receiving sheet according to claim 1, wherein an average particle diameter of the hollow particles contained in the heat insulation layer farthest from the support is 0.3 μm or more and 5.0 μm or less.

8. The heat-sensitive transfer image-receiving sheet according to claim 1, wherein the water-soluble polymer is a gelatin or a polyvinyl alcohol.

9. The heat-sensitive transfer image-receiving sheet according to claim 1, wherein the receiving layer contains at least one kind of latex polymer.

* * * * *